United States Patent [19]

Zanino

[11] Patent Number: 5,040,246

[45] Date of Patent: Aug. 20, 1991

[54] CLEANING FLUID DISPENSING ASSEMBLY FOR USE IN A FLUSH TOILET

[76] Inventor: Rocco Zanino, P.O. Box 4104, Redding, Pa. 19206

[21] Appl. No.: 515,458

[22] Filed: Apr. 27, 1990

[51] Int. Cl.[5] ..... E03D 9/03

[52] U.S. Cl. ..... 4/225

[58] Field of Search ..... 4/223, 224, 225, 227, 4/228; 137/441

[56] References Cited

U.S. PATENT DOCUMENTS

| | | | |
|---|---|---|---|
| 2,993,214 | 7/1961 | Franco . | |
| 3,001,210 | 9/1961 | Diehl | 4/225 |
| 3,009,168 | 11/1961 | Cooper | 4/228 |
| 3,911,507 | 10/1975 | Johnson | 4/224 |
| 3,964,108 | 6/1976 | Lissau | 4/223 X |
| 4,145,775 | 3/1979 | Butler | 137/441 X |
| 4,312,082 | 1/1982 | Murphy et al. | 4/228 |
| 4,429,423 | 2/1984 | Syrenne | 4/225 |
| 4,656,676 | 4/1987 | Dufau | 4/228 |
| 4,760,612 | 8/1988 | Dufau | 4/225 |

*Primary Examiner*—Henry J. Recla
*Assistant Examiner*—Robert M. Fetsuya
*Attorney, Agent, or Firm*—Terry M. Gernstein

[57] ABSTRACT

A flush toilet includes an assembly for dispensing cleaning fluid into the flush water. The assembly includes a diaphragm shutter valve in a conduit connecting a cleaning fluid storage container to a filler tube of the flush mechanism. The shutter valve is tripped open when the flush handle is actuated, and is set to remain open for a predetermined time, which can be less than the length of the flush cycle. When the valve is closed, flow of cleaning fluid from the storage container is prevented. The assembly further includes a venturi in the filler tube to further assist in controlling flow of cleaning fluid into the filler tube.

5 Claims, 4 Drawing Sheets

CLEANING FLUID DISPENSING ASSEMBLY FOR USE IN A FLUSH TOILET

TECHNICAL FIELD OF THE INVENTION

The present invention relates to the general art of bathroom fixtures, and to the particular field of toilet accessories.

BACKGROUND OF THE INVENTION

Many bathrooms, both public and private, suffer from cleanliness problems due to inadequate cleaning of the bowl of a toilet in that bathroom. This is especially a problem in public facilities. Even though a cleaning program is enforced, heavy usage between cleanings can create problems.

Most bathroom toilet fixtures are cleaned using special cleansers which are best applied using a scrubbing action. However, this can be a time-consuming and labor-wasting operation. Often this operation is not adequately carried out, especially if the individual is pressed for time, as when a great number of toilets must be cleaned, in a hotel or the like.

Accordingly, the art has included systems which place cleaning fluids in the water used to flush a toilet. These cleaning fluids are dispensed into such water when the water is being stored in the water storage tank associated with the toilet.

While somewhat effective, these devices have several drawbacks which inhibit their full commercial acceptance. For example, many of the most effective cleaning materials are incompatible with the seals, washers and connecting elements used in the toilet flush mechanism, and have a deleterious effect on such elements if exposed to such elements on a long term basis. In the case of a cleaning solution dispensing system that simply places cleaning solution in the water being stored in the water storage tank, the seals, and other such elements of that system will be exposed to the cleaning solution almost on a continuous basis. The seals, gaskets and washers will deteriorate after a certain period of time thus vitiating the effect of the cleaning solution dispensing process.

Another drawback to many of these cleaning solution dispensing devices is the wastefulness thereof. The cleaning solution is dispensed on a continuous basis, and thus may be dispensed when it is not really needed, or is dispensed in amounts that are too great at one time and not sufficient at other times. The wastefulness of these devices also vitiates the advantages thereof. Generally, the over-dispensing occurs when the device is first installed, and the under-dispensing occurs when the supply of cleaning material associated with the device is nearly exhausted. This leads to early replacement of the devices, again undermining the commercial advantages thereof.

These devices also may prove to be wasteful because the cleaning solutions therein are constantly exposed to either the air or to the flush water and thus tend to evaporate or to dissolve between uses.

Therefore, there is a need for a toilet flush system which dispenses cleaning fluid into the flush water only when necessary, and only in amounts required to effect a desired cleaning while maintaining the cleaning fluid separate from the flush water at other times and storing such cleaning fluid in an effective manner.

OBJECTS OF THE INVENTION

It is a main object of the present invention is to provide a toilet flush system which dispenses cleaning fluid into the flush water only when necessary.

It is another object of the present invention to provide a toilet flush system which dispenses cleaning fluid into the flush water only when necessary, and only in amounts required to effect a desired cleaning.

It is another object of the present invention to provide a toilet flush system which dispenses cleaning fluid into the flush water only when necessary, and only in amounts required to effect a desired cleaning while maintaining the cleaning fluid separate from the flush water at other times.

It is another object of the present invention to provide a toilet flush system which dispenses cleaning fluid into the flush water only when necessary, and only in amounts required to effect a desired cleaning while maintaining the cleaning fluid separate from the flush water at other times and storing such cleaning fluid in an effective manner.

SUMMARY OF THE INVENTION

These, and other, objects are achieved by a toilet bowl cleaning fluid dispensing assembly which includes a closed container for storing cleaning fluid in an airtight and fluid-tight manner. The container is connected to a toilet flush mechanism filler tube and has a flow control means that closes the container between uses and only permits cleaning fluid to be dispensed for predetermined periods during a flush sequence, while maintaining the container closed at other times. The assembly further includes a flow enhancing venturi in the filler tube which is in fluid communication with a conduit connecting the cleaning fluid container to the filler tube. A flow control valve is mounted in the conduit and is set to open when the toilet flush handle is operated and is set to open for a time period that can be set by the operator to open the container for such preset time to dispense cleaning fluid into the water flowing through the filler tube.

In this manner, only that amount of cleaning fluid desired is dispensed and then is dispensed only when necessary whereby the fluid is used in a conservative manner and the elements of the flush assembly are not overly exposed to the cleaning fluid when it can be avoided. The cleaning fluid storage container is located inside the Water storage tank and occupies a part of the water volume in that tank. This acts to conserve water during a flush cycle.

BRIEF DESCRIPTION OF THE DRAWING FIGURES

DETAILED DESCRIPTION OF THE PREFERRED EMBODIMENT OF THE INVENTION

Figure 1:
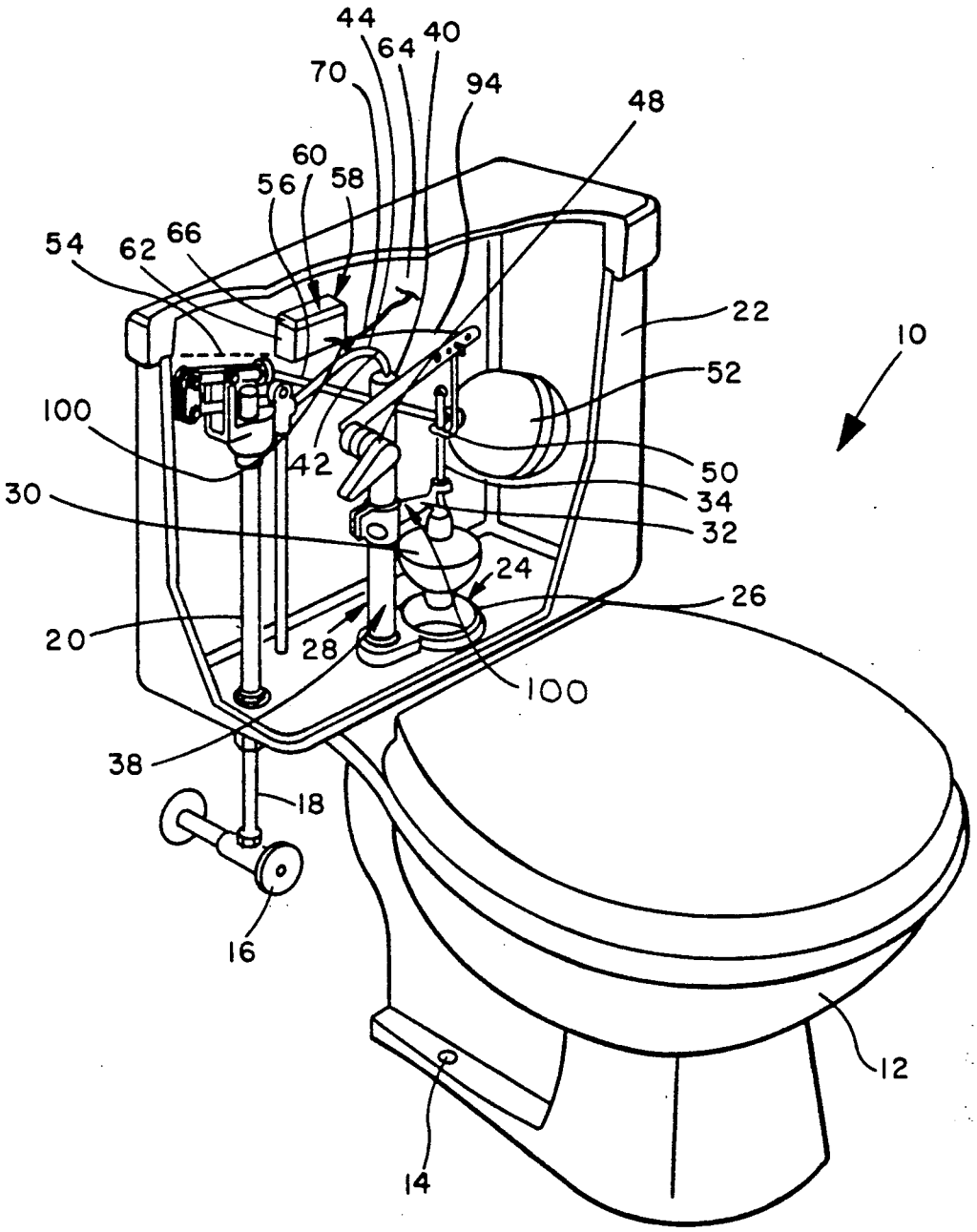
FIG. 1 is a perspective view of a flush toilet having a cleaning fluid dispensing assembly embodying the present invention.

Shown in FIG. 1 is a flush toilet 10 which includes a bowl 12 mounted on a support, such as a floor, by bolts 14 and which contains water for flushing. Water is dispensed into the bowl from a source (not shown) via a shutoff valve 16 and a source conduit 18 connected to an inlet tube 20 which is located inside a water storage tank 22 mounted on top of the bowl 12.

The flushing sequence is controlled by a flush mechanism located inside the water storage tank and which includes a flush pipe 24 connected to the storage tank 22 and to the bowl 12 to conduct water from the storage tank 22 in a manner that flushes that bowl. The flush pipe 24 includes an inlet valve seat 26 thereon, and a tank ball mounting unit 28 is mounted on the tank 22 adjacent to the inlet valve seat 26. A tank ball 30 is mounted on the unit 28 by a guide arm 32 and a lift wire 34 to move from a first position occluding the inlet valve 26 to a second position, shown in FIG. 1, uncovering such inlet valve and permitting water from the storage tank 22 to flow into the flush pipe 24.

The flush mechanism further includes an overflow tube 38 which is mounted on a lower end thereof on the storage tank and has an open upper end 40 in which an outlet end 42 of a filler tube 44 is located. The filler tube 44 is connected to the fluid source to dispense water into the overflow tube 38 as is common in flush sequences.

The flush mechanism also includes a flush trip handle 48 mounted on the storage tank and connected to the float lift wire 34 by a connection wire 50. Operation of the flush trip handle 48 initiates the flush sequence by lifting the float from its occluding position on the flow inlet valve 26.

As is usual in such flush mechanisms, a float ball 52 is connected to a ball-cock assembly 54 by a float arm 56 to stop the flush sequence when the tank 22 is full.

The flush toilet 10 further includes a cleaning fluid injection unit 58 located inside the water storage tank 22 to inject cleaning fluid, such as chlorine bleach or the like, into the flush water just prior to that flush water being injected into the overflow tube 38 and only for a predetermined time.

Figure 2:
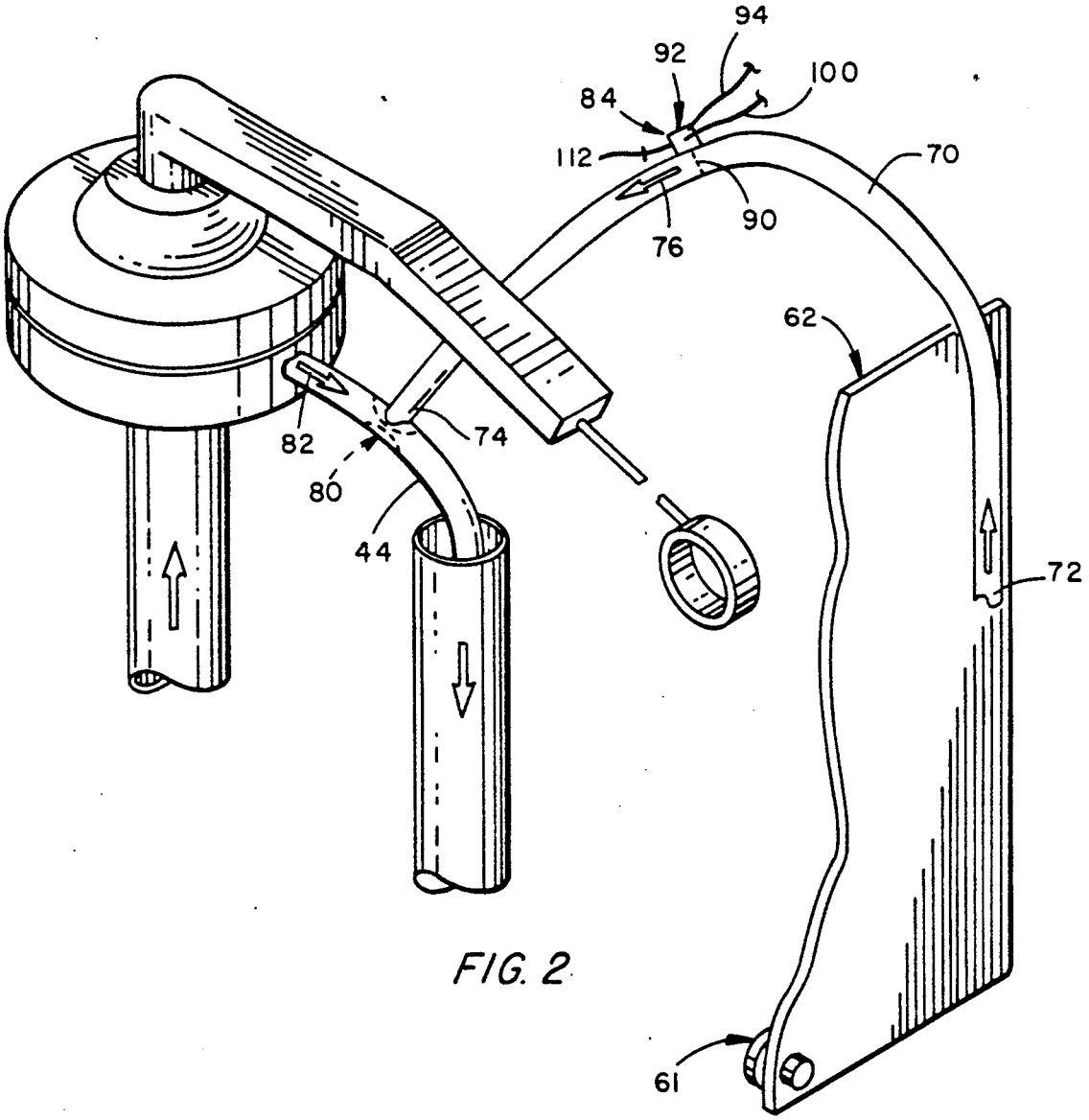
FIG. 2 is a perspective view of a cleaning fluid dispensing assembly embodying the present invention.
Figure 4:
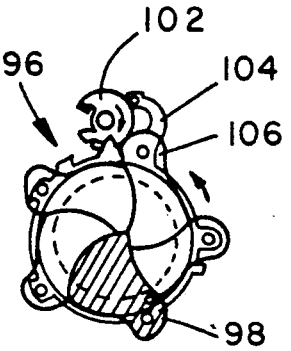
FIGS. 4–7 illustrate a diaphragm shutter mechanism that is mounted in a conduit used to dispense cleaning fluid and which controls the amount of time that conduit is open.
Figure 5:
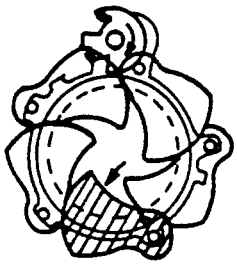

The cleaning fluid system is best shown in FIGS. 1 and 2 and include a cleaning fluid storage tank 60 having a body 62 securely affixed, as by a fastener 61, to one wall 64 of the water storage tank 22. A top 66 is releasably mounted on the body 62. When the top is securely on the body, the storage tank 60 occupies some of the volume in the water storage tank so that water usage is reduced.

A cleaning fluid conduit 70 having an inlet end 72 located inside the container body 62 and an outlet end 74 fluidically connected to the filler tube 44 to conduct cleaning fluid in the direction of arrow 76 from the storage container into the filler tube.

Figure 3:
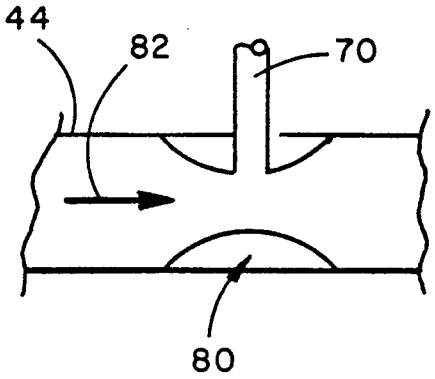
FIG. 3 illustrates a venturi located in a filler tube of the flush toilet and which forms part of the flow control assembly of the dispensing assembly of the present invention.

A venturi 80 is located in the filler tube 44, and the conduit outlet end 74 is connected to the filler tube adjacent to the venturi so that the venturi can enhance the flow of fluid from the conduit into the filler tube in the manner of a venturi in an internal combustion engine carburetor. As is indicated in FIG. 3, the conduit 70 is connected to the throat section of the venturi, and flow in the filler tube moves past the throat in the direction indicated by arrow 82.

The amount of cleaning fluid dispensed into the filler valve during a flush sequence is controlled by a flow control valve assembly 84, best shown in FIGS. 3–8. The flow control valve assembly is set to open the conduit for a predetermined amount of time during a flush sequence, and this setting can be varied to dispense more or less cleaning fluid as desired. The flow control assembly co-operates with the venturi, and the setting of the flow control assembly can be varied between flush sequences if it is found that too much or too little cleaning fluid has been dispensed during a flush sequence.

The flow control assembly includes a flow control valve 90 inserted into the conduit 70 and an operating mechanism 92 mounted on the conduit 70 and connected to the flow control valve and to the flush trip handle by a trip cord 94. Operation of the flush trip handle to initiate a flush sequence activates the flow control assembly to open the flow control valve for the pre-set time during that flush cycle. The flow control valve closes automatically after the pre-set time, even if the flush cycle has not been completed, and thus stops flow of cleaning fluid through the conduit 70 into the filler tube 44.

Figure 6:
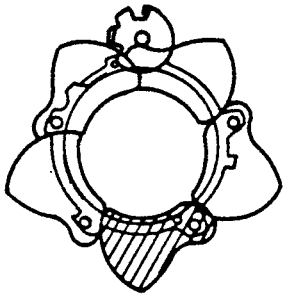
Figure 7:
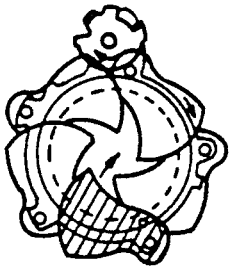
Figure 8:
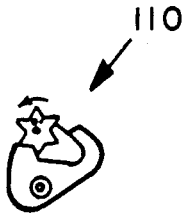
FIG. 8 is a star-wheel escapement mechanism used to control the time the diaphragm shutter mechanism is open.

The preferred form of the flow control valve 90 is best shown in FIGS. 4–7 as including a diaphragm shutter mechanism 96. The diaphragm shutter mechanism is similar to a shutter mechanism used in cameras, and includes a plurality of shutter leaves, such as shutter leaf 98 pivotally mounted on a frame that is mounted inside the conduit 70 to open out in a direction away from the flow axis, and then upon completion of the preset time, to close the conduit by moving back towards the flow axis. The shutter is cocked by movement of the float ball 30 back into its original position covering the inlet valve 26 via a wire 100. With reference to a single leaf, the shutter mechanism operates as follows. The shutter is closed in FIG. 4. A drive element 102 rotates under influence of a spring or the like, and thrusts against shutter-opening pin 104 of an actuating ring 106, causing the ring to rotate counterclockwise. Other pins mounted on this ring engage with slots in the shutter leaves and cause these to swing about their respective pivots. In FIG. 6, the shutter is fully opened. Further rotation of the drive element is now prevented by an escapement mechanism 110, such as shown in FIG. 8, or other such mechanism and is used with an oscillating anchor to control the movements of cog wheels. When the pre-set opening period has expired, and the escapement has run down, the drive element continues its rotation in the same direction as before. A projection on the drive element now thrusts against the shutter-closing pin on the actuating ring and causes this ring to rotate in the reverse direction, so that the shutter leaves close again.

By adjusting the escapement mechanism using a handle 112, the opening time of the flow control valve is set. A preferred time of opening is approximately eighty percent of the total flush cycle. The leaves and the other elements of the shutter mechanism are fabricated of materials that will not degrade upon long exposure to cleaning solutions.

Figure 9:
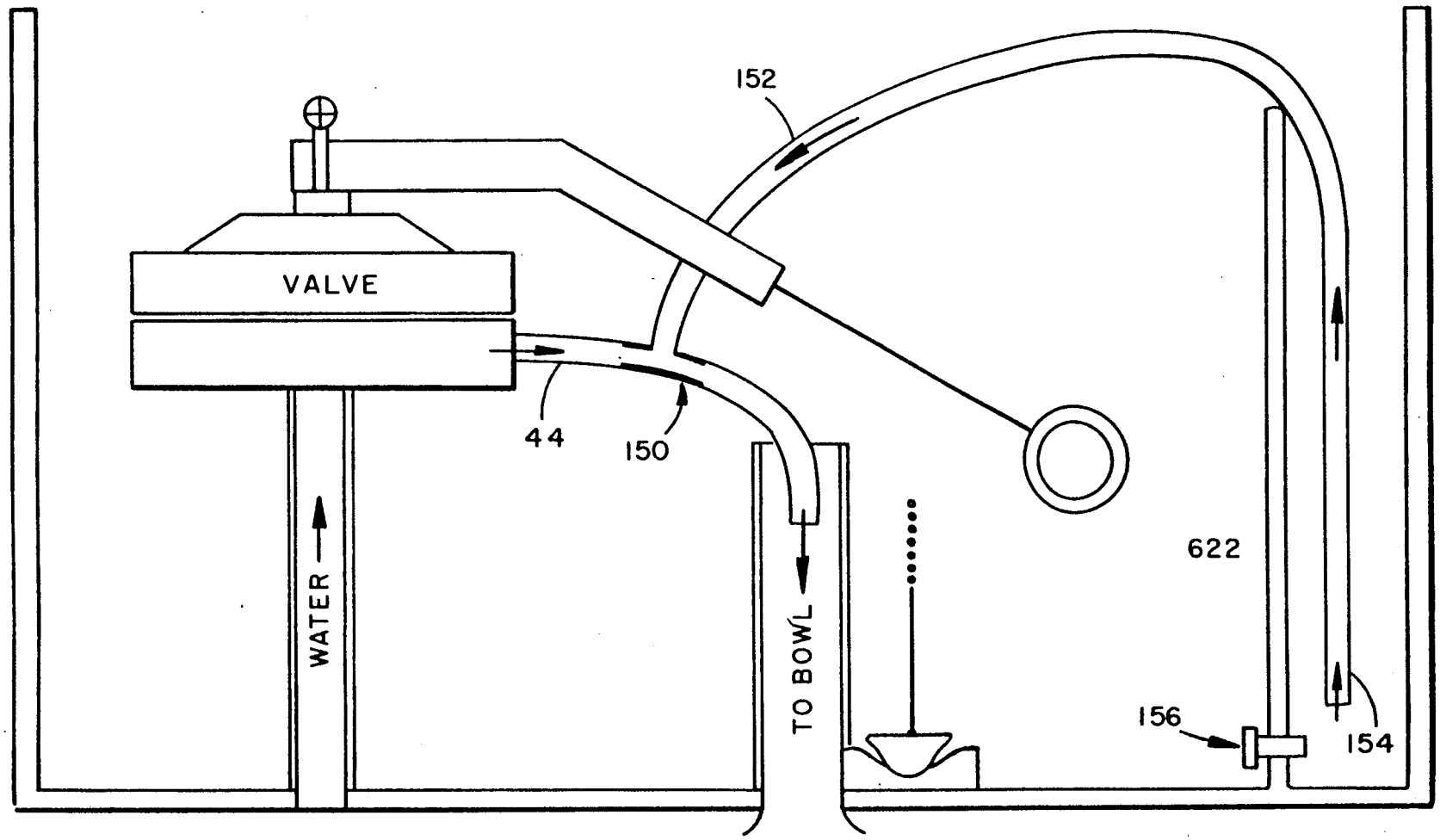
FIG. 9 is another embodiment of the system.

Shown in FIG. 9 is an embodiment of the system in which an aspirator element 150 is placed in the line 70.

The aspirator element is connected to a line 152 which has an end 154 located in body 62. A plug 156 is also located in a bore defined through the wall of the body 62.

BY using an aspirator as shown in FIG. 9, modification of an existing toilet will be quite easy to effect. All that is required is to replace tube 44 with a tube containing the aspirator 150. The aspirator can be spliced into an existing tube. The tube 152 acts like a capillary to pick up fluid from the body 62.

It is also noted that the body 62 can be located outside of the toilet tank so that it can be purchased at a supermarket and installed as necessary to replenish the supply of fluid, such as odor counteracting substance, cleaner or the like.

It is understood that while certain forms of the present invention have been illustrated and described herein, it is not to be limited to the specific forms or arrangements of parts described and shown.

I claim:

1. A toilet assembly comprising

A) a bowl unit for containing water;

B) a water storage tank fluidically connected to said bowl unit to transfer water to said bowl unit for flushing purposes;

C) a flush control mechanism controlling the flow of water into said bowl unit from said water storage tank and including (1) a flush pipe having an inlet end fluidically connected to said water storage tank and an outlet end fluidically connected to said bowl unit, (2) a tank ball mounting unit mounted in said water storage tank, (3) a tank ball movably mounted on said tank ball mounting unit to move from a first position occluding said flush pipe inlet end to a second position uncovering said flush pipe inlet end, (4) an overflow tube mounted in said water storage tank, (5) a water inlet conduit connected to a source of flush water and having an outlet end located inside said water storage tank, (6) a filler tube having a first end thereof fluidically connected to said water inlet conduit outlet end and having a second end in fluid communication with said overflow tube for conducting water into said overflow tube, and (7) a flush trip handle mounted on said water storage tank and connected to said tank ball to move said tank ball into said tank ball second position when said flush trip handle is operated, and D) a cleaning fluid injection unit mounted in said water storage tank and injecting cleaning fluid into flush water prior to said flush water entering said overflow tube, said cleaning fluid injection unit including (1) a cleaning fluid storage container mounted on a wall of said water storage tank, (2) a cleaning fluid conduit having an inlet end connected to said cleaning fluid storage container to received cleaning fluid therefrom and an outlet end connected to said filler tube between said filler tube first and second ends, (3) a cleaning fluid flow control means which includes (a) a venturi located inside said filler tube, (b) said cleaning fluid conduit outlet end being associated with said venturi, (c) a flow control valve mounted in said cleaning fluid conduit and including (i) a diaphragm shutter mechanism mounted in said cleaning fluid conduit and being movable from an open position which permits cleaning fluid to flow therepast into a closed position which occludes said cleaning fluid conduit, said diaphragm shutter mechanism being normally in said closed position, and (ii) a diaphragm shutter operating means connected to said tank ball to place said diaphragm shutter mechanism in said open position when said flush trip handle is operated and to move said diaphragm shutter mechanism back into said closed position after a pre-set time.

2. The toilet assembly defined in claim 1 wherein said diaphragm shutter operating means further includes a trip cord connected to said tank ball.

3. The toilet assembly defined in claim 2 wherein said cleaning fluid storage container includes a body fixed to said storage tank and a top removably mounted on said body.

4. The toilet assembly defined in claim 3 wherein said cleaning fluid includes bleach.

5. The toilet assembly defined in claim 4 wherein said diaphragm shutter operating means includes an escapement mechanism.

* * * * *